US006555775B1

(12) United States Patent
Van Bokhoven et al.

(10) Patent No.: US 6,555,775 B1
(45) Date of Patent: Apr. 29, 2003

(54) SWITCH FOR ELECTRIC TOOLS

(75) Inventors: Eric H. T. Van Bokhoven, Velhoven (NL); Cornelius G. Bressers, Bergeijk (NL)

(73) Assignee: Capax B.V., Eindhoven (NL)

( * ) Notice: Subject to any disclaimer, the term of this patent is extended or adjusted under 35 U.S.C. 154(b) by 0 days.

(21) Appl. No.: 09/557,005

(22) Filed: Apr. 20, 2000

(30) Foreign Application Priority Data

Apr. 20, 1999 (NL) ..... 1011843

(51) Int. Cl.[7] ..... H01H 9/06

(52) U.S. Cl. ..... 200/522; 200/332.2; 338/176; 338/178

(58) Field of Search ..... 200/16 R–16 D, 200/61.85, 522, 293, 293.1, 352.1, 332.2; 310/48, 50; 338/176, 178, 179, 184, 198, 200

(56) References Cited

U.S. PATENT DOCUMENTS 3,761,788 A 9/1973 Rhine et al. ..... 318/345
4,097,704 A 6/1978 Piber ..... 200/157
4,118,614 A 10/1978 Leibundgut ..... 200/157
4,241,297 A * 12/1980 Piber et al. ..... 318/17
4,400,685 A * 8/1983 Chestnut ..... 338/172
4,698,471 A * 10/1987 Piber ..... 200/302.2
4,980,801 A 12/1990 Guinda et al. ..... 361/394
5,084,598 A 1/1992 Nagata et al. ..... 200/16 C
5,198,793 A * 3/1993 Leveque ..... 338/172
5,835,351 A * 11/1998 Ulanski et al. ..... 361/704
5,877,691 A 3/1999 Supitz et al. ..... 340/638
6,262,380 B1 * 7/2001 Sasaki et al. ..... 200/6 BB

* cited by examiner

*Primary Examiner*—Michael Friedhofer
(74) *Attorney, Agent, or Firm*—Banner & Witcoff, Ltd.

(57) ABSTRACT

A switch for electric hand-tools includes: a switch housing with a switching device arranged therein; and a carriage arranged movably in the housing and which is drivable by a trigger connected thereto. The carriage is provided with at least one slider for sliding over a potentiometer track and with at least one movable contact of a mechanical switch. The switch housing is provided with an electrical connecting system which, when a module is arranged on the switch housing, is adapted to form an electrical connection between the switch housing and the module. The switch housing with the switching device arranged therein can be adapted, by connecting a module thereto, to provide an additional switch function and to adapt to a specific method of connection of the wires to be connected to the switch.

16 Claims, 2 Drawing Sheets

SWITCH FOR ELECTRIC TOOLS

BACKGROUND OF THE INVENTION

The present invention relates to a switch unit for electric hand-tools, comprising a switch housing with switching means arranged therein, a carriage which is arranged movably in the housing and which is drivable by a trigger connected thereto, wherein the carriage is provided with at least one slider for sliding over a potentiometer track and with at least one movable contact of a mechanical switch.

Such switches are generally known.

To be able to compete with the generally decreasing price levels of these switches, optimal flexibility in the construction and the design of the switches is required. Manufacturers of electric hand tools generally order with short notice, and they often decide on amendments in the design of those switches at a late stage.

SUMMARY OF THE INVENTION

To be able to cope with these requirements, the aim of the invention is to provide a switch unit for such applications, which can be composed of several more or less standard components, and which can be assembled from those components according to need.

Therefore, the invention provides a switch unit, wherein the switch housing of the switch unit is divided into two parts, wherein the fixed contacts of the mechanical switch are arranged on a first part and the potentiometer track and the electronic components related thereto are arranged on the second part of the switch housing.

These features provide a possibility to adapt both sides of the housing to the requirements of the tool in which it is to be inserted, such as the type of electric supply, electric power level, range of switching, or type of semiconductor to be used for power control. By having all these different possibilities available in the second half of the housing, the requirements can be met by choice. Although the possibilities of choice appear the most in DC power, the invention is not limited to DC-control; it is just as well applicable to AC-control.

Due to the separation between electronic functions and switching, wherein for the operation of both functions use is made of the same movable element, i.e., the carriage, a degree of separation of functions is obtained without the space-saving integration of the switch being negated.

It is of course possible herein for both the slider and the operating element for the switching functions to be arranged on one side of the carriage, but it is equally possible for the slider and the contact to be arranged on either side of the carriage, and for the potentiometer track and the fixed switching contacts of the switch to be arranged on the relevant inner sides of the housing. This latter possibility would generally seem to be structurally more attractive.

According to another preferred embodiment, the switch unit includes an adaptation module. Between the switch housing and the adaptation module, the switch housing is provided with electrical connecting means which, when the adaptation module is arranged on the switch housing, are adapted to form an electrical connection.

This feature provides the possibility to include an additional switching function in such a switch unit. An example of such an extra switching function is reversing polarity to cause the electric motor of electric hand-tools to rotate in the other direction, for instance in drilling or screwing machines.

Another example of such a function is the adaptation to an electrical connection with the motor and the field winding or with the battery or the mains connection. Many types of connections are applied for this purpose. In this diversity of connecting methods, such as screw clamps, plug clamps, soldered connections, spring loaded contacts, connections and so on, the design of the contacts of the switch must always be adapted.

These measures have the result that a switch housing with the switching means arranged therein can be adapted, by connecting a module thereto, to provide an additional switch function and to adapt to a specific method of connection of the wires to be connected to the switch.

It is further attractive when at least the first part of the housing of the switch is manufactured from plastic and at least a number of the fixed contacts and the conductors connected thereto are embodied integrally and arranged in the plastic.

This saves a large number of fitting operations.

According to yet another preferred embodiment, the switch unit comprises a number of heat generating components and at least a part of the number thereof is mounted on a flat carrier, and the carrier is located between the second part of the switch housing and the path of the slider.

In principle, it is herein possible to make use of specific plastics suitable for this purpose, although it is also possible to make use of ceramic material, metal, metal oxides and the like.

According to another embodiment, the second part of the switch housing is made from metal.

Particularly in the application of a switch in an electric hand-tool, which is powered by a battery, such a switch usually comprises at least one component in which a considerable quantity of heat is generated. It is attractive to place such a component on a metal carrier, since metal is a good heat conductor. This provides the option of including in the carrier the function of a cooling plate in the calculation of the heat dissipation of the components placed on the carrier.

A dual function of the carrier is thereby obtained, that is the actual carrier function, a housing function, and a cooling plate function.

In another embodiment, the second part of the switch housing is made from plastic, and between the carrier and the second part of the switch housing, a metal plate is inserted.

The carrier is preferably provided with cooling ribs arranged on the outside.

In order to complete the modular system, it is attractive to make use of the same switch for different dimensions, that is for circuits with high heat dissipation and circuits with a lower heat dissipation. It is therefore attractive in the case of components with a high heat dissipation to make use of a metal carrier and in the case of other circuits to make use of a plastic carrier.

The measure that the metal carrier corresponds with a housing half provides the possibility of easy replacement thereof by a housing half of another material, for instance plastic. It is also possible herein to arrange the carrier in the relevant housing half, for instance by means of a snap connection.

It is of course essential for the module to be connected not only mechanically but also electrically to the switch housing and the switching means present therein. It is attractive for this purpose when the switch housing is adapted to make spring loaded connections for electrical contact with the module.

It will be apparent that this limits the amount of fitting work considerably. The operation of joining together the switch housing and module for placing thereon can after all be readily carried out by a mechanical process.

Since the module, which is adapted to execute an additional switching function, must of course also not only be connected to the actual switch housing, but also provided with external connections, it is attractive when a module is adapted to perform an additional switching function and is adapted to make plug connections for electrical contact with the switch and with a further module to be arranged on the module.

This further module then serves to connect the external connections.

An example of an additional switching function which can be performed in a module is the function of a polarity reversal module.

The additional, electrical switching function is however certainly not limited to this polarity reversal function. It is equally possible to add other additional functions, such as that of a mains filter.

A module is preferably formed by a connecting module which is adapted to make a plug connection to the switch or another module, and which is provided with connecting means for making an external connection.

This measure provides the option of adapting a switch to the method of attachment of the external connections without making structural changes to the actual switch. Modules can herein be envisaged which are adapted to make a solder connection for a socket joint, a screw clamp connection and the like.

The measures described heretofore relate only to external functions, which are separated per se from the actual switch.

BRIEF DESCRIPTION OF THE DRAWINGS

The present invention will be elucidated hereinbelow with reference to the annexed figures, in which.

DETAILED DESCRIPTION OF THE INVENTION

Figure 1:
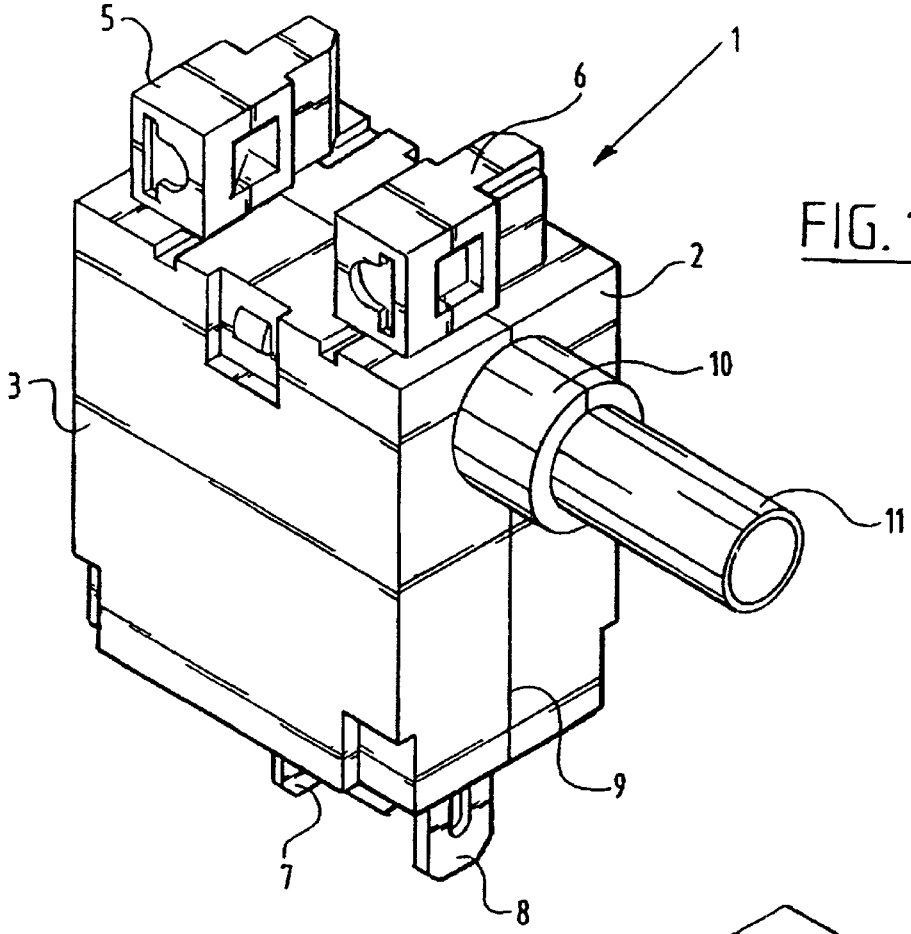
FIG. 1 shows a perspective view of a switch according to the present invention.

FIG. 1 shows a switch which is designated as a whole by reference number 1. The switch 1 is adapted for mounting in the housing of an electric hand tool, such as an electric drill.

Switch 1 comprises a housing formed by two halves 2 and 3.

Figure 3:
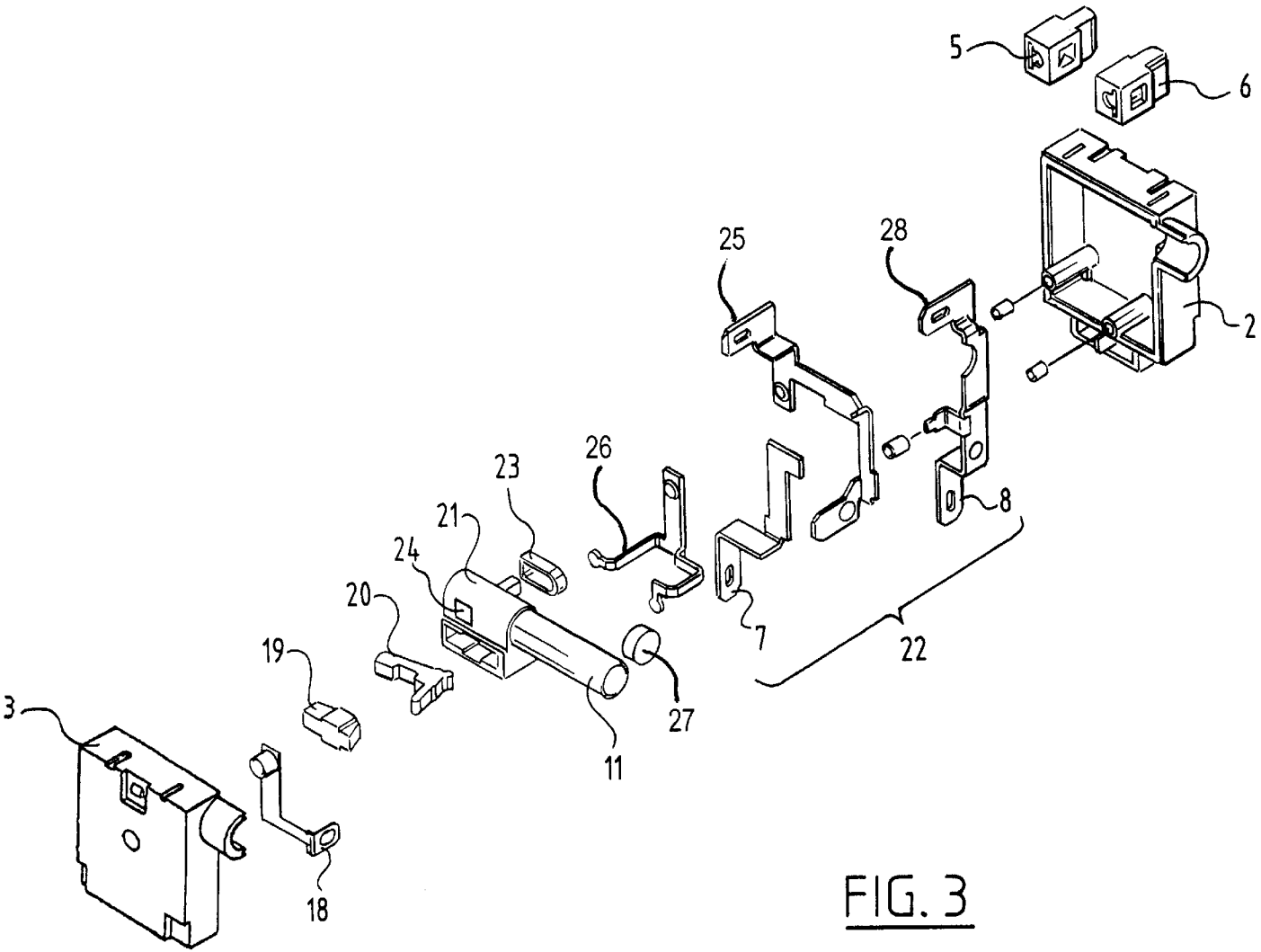
FIG. 3 shows an exploded view of the switch shown in FIG. 1.

The housing is further provided on its top side with adapting connections 5 and 6 and on its underside with connecting lips which are formed as a portion of strips 7 and 8 shown in FIG. 3. On the separating seam 9 between the two housing halves 2 and 3, an opening is arranged which is enclosed by a guide cylinder 10, inside of which is arranged a control rod 11 for operating the switch. The separating seam 9 between the two housing halves 2 and 3 extends through cylinder 10.

As is usual in the prior art, the first housing half 2 is manufactured from plastic.

Figure 2:
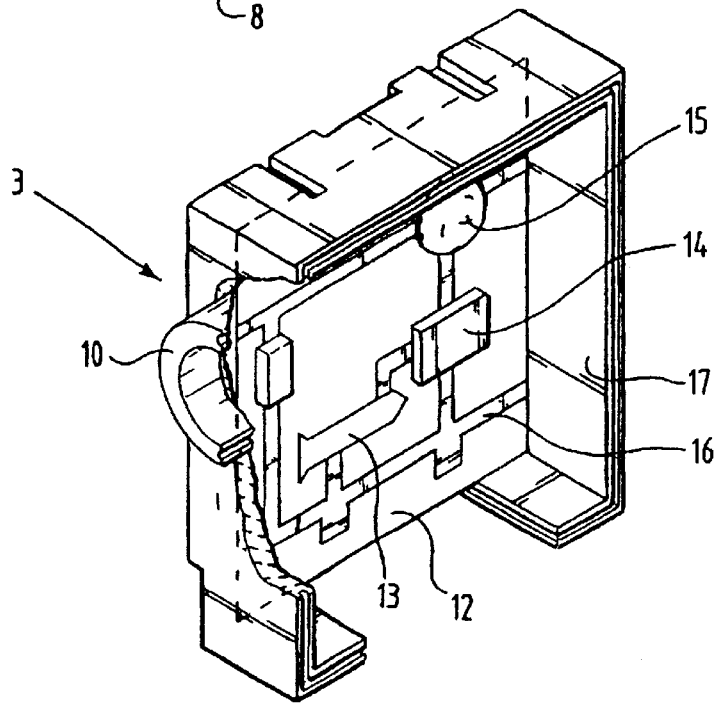
FIG. 2 shows a partly broken-away view of a housing half of the switch shown in FIG. 1.

The other housing half 3, the inside view of which is shown partly broken-away in FIG. 2, is manufactured from metal. The components needed for the electronic circuit are arranged on a separate carrier 12, which is usually made from ceramic material. It is, however, also possible to use other materials, like aluminum oxide, plastic, etc. These components arranged on the carrier 12 are usually manufactured in the so-called "thick-film technique," so that the carrier 12 is subjected to high temperatures during manufacture.

As can be seen in FIG. 2, the diverse components of the circuit are fixed against the carrier 12. The relevant operations also comprise calibration of a resistor 13 in the form of a carbon film.

The circuit further comprises other diverse components, such as elements 14 and 15. They are connected by tracks 16 arranged on the carrier 12. Component 14 is the electronic component executing the switch function, like a FET, GTO, etc., and which dissipates the most heat.

In the embodiment shown here, the carrier 12 is provided wholly flat, so that a separate housing half 3 is fixedly connected to the flat carrier 12 by means of, for instance, a close-fitting connection. However, it is also possible to embody the carrier 12 with standing edges 17 for forming a housing half. It is also possible to make a monolithic housing which is provided with an opening in which the ceramic flat carrier can be placed, for instance in a close-fitting manner.

FIG. 3 shows the diverse components of the whole switch. Thus, shown successively from left to right are: housing 3, a contact strip 18, a slider 19, and an operating element 20, which are driven by means of a sliding body or carriage 21 when rod 11 is driven in a sliding movement by the trigger of the switch connected thereto. Slider 19 herein (also called a "heat resistant holder" in this application) slides along carbon tract 13 so that the resistance is thereby changed and power control of the electric motor coupled to the switch is possible.

Diverse strips 7 and 8 shown combined as 22 are manufactured from conductive material. These strips are further arranged in such a manner either to ensure an interconnection, such as the short-circuiting of the power control components of the switch, or the switching on and off of the switch. This combination 22 includes conducting strips 25 and 28, which include contact extensions that extend above the switch housing halves 2 and 3. The lower lips on strips 7 and 8, which extend from the bottom of the housing 2, 3, serve as external contacts for the power supply, while upper contacts 25 and 28 interconnect with housing adapting connections 5 and 6, respectively, which may be interconnected to the operating mechanism of the electric hand tool.

An important aspect of the switch according to the invention is the modular structure; it is thus possible, for instance, to replace the housing half 3 manufactured from metal by a housing manufactured from plastic. This is of course less expensive, but it is only possible when the heat dissipated in the circuit components is much less. Use is then usually made of a separate carrier, manufactured from, for instance, ceramic material, such as is possible in the above described embodiment.

This ceramic carrier can be received in the relevant housing half by a close-fitting connection, for instance, a snap connection.

Although not depicted in the drawings, it is possible to mount the component in which most heat is dissipated at the outside of the housing half 3. Of course one will only choose this structure when the heat dissipated by that component cannot be removed from the inside of the housing.

In such a case, contact pieces are used which are connected to the carrier in the same way as a power dissipated component, which is directly mounted on the carrier, like through spring pressure. Those contact pieces are folded around an edge of the carrier and extend through the housing, insulated if the housing is made of metal. The contacts of the outside component are then soldered to the contact pieces.

In addition, it is attractive to divide the diverse circuit components of the switch into two groups, i.e., the electronics, which are arranged on the side of the housing half 3, and the actual circuit elements, which are arranged on the side of housing half 2.

The possibility is herein provided of replacing both types of circuits independently of each other, whereby the modular character of the switch is enhanced.

For this purpose, carriage 21 is provided with a heat-resistant holder 19 or slider 19 and its operating element 20. The slider 19 and operating element 20 protrude through carriage 21 and control the main switching functions, situated on the other side of carriage 21, and on the other side of strips 22. Heat resistant holder (also called "slider") 19 can be formed integrally with carriage 21 in such cases. Carriage 21 is likewise provided with a slider 24 made from electrically conductive rubber which regulates the power using a potentiometer tract or the ceramic carrier. Element 23 is the braking contact which, when the switch is in the off position, short-circuits the output contacts and thus slows down the direct-current motor.

To complete the switch as shown in FIG. 3, an internal contact strip 26 is provided for internal connection to the switch while 27 is a diode mounted in the housing for protection of the switching semiconductor performing the switching function.

A final aspect of the modular character of the circuit is obtained through connecting lips 7 and 8 as described above. These lips provide the option of coupling a module to the relevant side of the switch, for instance, in the form of two clamps 5, 6 which are suitable for forming a clamp connection with wires to be connected to the clamps. Corresponding modules can of course likewise be placed on the underside. The modules can also be combined into a separate unit.

This provides the possibility of varying the manner of connection by means of replacing the unit. This can take place on both the power supplying side and the supplied side of the switch. As one example, the adaptation modules may be used to make electrical contact to a rechargeable battery.

This construction further provides the possibility of placing an extra switching module, not shown in the drawings, for instance, for performing an additional switching function. A polarity reversal function or the placing of for instance a mains filter can for instance be envisaged here.

What is claimed is:

1. A switch unit for electric hand-tools, comprising:

a switch housing with a mechanical switch arranged therein, wherein the switch housing includes: (a) a first part made of plastic, wherein fixed contacts of the mechanical switch are arranged on the first part and wherein at least one of the fixed contacts and a conductor connected thereto are embodied integrally and arranged in the plastic of the first part, and (b) a second part;

a flat carrier arranged on the second part of the switch housing, wherein a potentiometer tract and at least one heat generating component are arranged on the flat carrier; and a carriage movably arranged in the housing and drivable by a trigger connected thereto, wherein the carriage is provided with a first slider for sliding over the potentiometer tract and is provided with at least one movable contact of the mechanical switch.

2. A switch unit as claimed in claim 1, wherein the second part of the switch housing is made from metal.

3. A switch unit as claimed in claim 2, wherein the second part of the switch housing includes ribs.

4. A switch unit as claimed in claim 1, wherein the second part of the switch housing is made from plastic, and the switch unit further includes a metal plate between the carrier and the second part of the switch housing.

5. A switch unit as claimed in claim 4, wherein the second part of the switch housing includes ribs.

6. A switch unit as claimed in claim 1, wherein the second part of the switch housing includes ribs.

7. A switch unit as claimed in claim 1, further including an adaptation module arranged on the switch housing, and electrical connecting means extending between the switch housing and the adaptation module for forming an electrical connection.

8. A switch unit for electric hand-tools, comprising:

a switch housing with a mechanical switch arranged therein, wherein the switch housing includes: (a) a first part, wherein fixed contacts of the mechanical switch are arranged on the first part, and (b) a second part, wherein a potentiometer tract and electronic components are arranged on the second part;

a carriage movably arranged in the housing and drivable by a trigger connected thereto, wherein the carriage is provided with a first slider for sliding over the potentiometer tract and is provided with at least one movable contact of the mechanical switch;

an adaptation module arranged on the switch housing; and electrical connecting means for forming an electrical connection, wherein the electrical connecting means extends between the switch housing and the adaptation module.

9. A switch unit as claimed in claim 8, wherein the adaptation module allows electrical contact between the mechanical switch and a further adaptation module to be arranged on the adaptation module.

10. A switch unit as claimed in claim 9, wherein the adaptation module is a polarity reversal module.

11. A switch unit as claimed in claim 9, wherein the adaptation module is formed as a connecting module that allows electrical contact between the mechanical switch and another module, and wherein the adaptation module is provided with connecting means for making an external connection to the another module.

12. A switch unit as claimed in claim 8, wherein the adaptation module is a polarity reversal module.

13. A switch unit as claimed in claim 12, wherein the adaptation module is formed as a connecting module that allows electrical contact between the mechanical switch and another module, and wherein the adaptation module is provided with connecting means for making an external connection to the another module.

14. A switch unit as claimed in claim 12, wherein the adaptation module allows electrical contact with a rechargeable battery.

15. A switch unit as claimed in claim 8, wherein the adaptation module is formed as a connecting module that allows electrical contact between the mechanical switch and another module, and wherein the adaptation module is provided with connecting means for making an external connection to the another module.

16. A switch unit as claimed in claim 15, wherein the adaptation module allows electrical contact with a rechargeable battery.

* * * * *

UNITED STATES PATENT AND TRADEMARK OFFICE

CERTIFICATE OF CORRECTION

PATENT NO. : 6,555,775 B1
DATED : April 29, 2003
INVENTOR(S) : Eric H.T. Van Bokhoven It is certified that error appears in the above-identified patent and that said Letters Patent is hereby corrected as shown below:

Title page,
Item [75], Inventors, "Velhoven" has been replaced with -- Veldhoven --.

Signed and Sealed this

Twenty-seventh Day of January, 2004

JON W. DUDAS
*Acting Director of the United States Patent and Trademark Office*